United States Patent [19]

Schmitt et al.

[11] Patent Number: 4,945,580

[45] Date of Patent: Aug. 7, 1990

[54] VOLUME-SELECTIVE WATER CLOSET FLUSHING SYSTEM

[76] Inventors: Marvin M. Schmitt, 2 N. 42nd Ave., Yakima, Wash. 98907; Richard Sela, 801 Terrace Ht. Dr., Yakima, Wash. 98901

[21] Appl. No.: 349,054

[22] Filed: May 9, 1989

[51] Int. Cl.[5] ..... E03D 1/14

[52] U.S. Cl. ..... 4/325; 4/405; 4/415; 4/396

[58] Field of Search ..... 4/366, 395, 396, 404, 4/324, 325, 345, 407, 413, 414, 415, 405, 379

[56] References Cited

U.S. PATENT DOCUMENTS

| | | | |
|---|---|---|---|
| 2,869,141 | 1/1959 | Koch et al. | 4/404 |
| 2,883,675 | 4/1959 | Hartman, Jr. | 4/404 |
| 3,165,756 | 1/1965 | Simpson | 4/404 |
| 3,324,482 | 6/1967 | Wustner | 4/325 |
| 3,331,084 | 7/1967 | Wustner | 4/325 |
| 3,546,715 | 12/1970 | Wustner | 4/325 |
| 3,590,395 | 7/1971 | Wustner | 4/404 |
| 4,000,526 | 1/1977 | Biela et al. | 4/325 |
| 4,032,997 | 7/1977 | Phripp et al. | 4/52 |
| 4,117,556 | 10/1978 | Semler | 4/325 |
| 4,216,555 | 8/1980 | Detjen | 4/324 |
| 4,328,596 | 5/1982 | Renz | 4/324 |
| 4,391,003 | 8/1983 | Talerico et al. | 4/415 |
| 4,593,419 | 6/1986 | Derus | 4/324 |
| 4,624,018 | 11/1986 | Kurtz | 4/325 |
| 4,651,359 | 3/1987 | Battle | 4/324 |

FOREIGN PATENT DOCUMENTS 3140033 10/1981 Fed. Rep. of Germany .

*Primary Examiner*—Henry J. Recla
*Assistant Examiner*—Glenn T. Barrett
*Attorney, Agent, or Firm*—George A. Cashman

[57] ABSTRACT

A buoyant outlet closure, or 'flapper' in the preferred embodiment, is vented at a selectively predetermined time in the water closet flushing cycle, causing the flapper to become non-buoyant and to drop and to close the tank outlet, effecting a premature termination of the flushing cycle, and saving the volume of water remaining in the tank. The venting is controlled by turning the externally mounted operating handle in one direction. When the operating handle is turned in the opposite direction, essentially all the water is discharged from the tank, effecting a full flush cycle.

9 Claims, 9 Drawing Sheets

PARTIAL

FULL

VOLUME-SELECTIVE WATER CLOSET FLUSHING SYSTEM

BACKGROUND OF THE INVENTION

1. Field of the Invention

The invention described herein is a water-saving device designed for installation in the water tank of new or existing flush water closets (toilets).

Shortages of potable water exist in almost every area of the United States, sometimes on a temporary basis caused by a decrease in the normal amount of rainfall, and, in some places such as the Arizona-California area, on a permanent basis, caused by burgeoning population in an area not blessed with very much water to begin with. A significant portion of the supply of potable water is used to flush toilets. Most toilets are equipped with a storage tank, typically containing several gallons of water, almost all of which is used for each flushing of the toilet. It is often unnecessary to utilize the full tank of water to flush the toilet, but few toilets are equipped with means to reduce selectively the amount of water that is used in the individual flush cycle.

2. Description of the Related Art

One simple means of reducing the amount of water used during a toilet flushing cycle is the use of a brick or similar cheap, heavy, bulky article to reduce the amount of water available for a flush. This means of reducing the amount of water used has certain disadvantages. It represents a permanent reduction in water availability, even though there are occasions when a full flush is essential. Further, the brick tends to erode, and the hard particles can damage the outlet closure, whether a ballcock or flapper, and the seat on which it rests. Another disadvantage is that the pressure at the tank outlet diminishes rapidly as the flush progresses, lessening the force of the flush.

Numerous patents have been granted in the field of saving water by reducing the amount of water discharged from a toilet tank. One common characteristic shared by all such inventions is the manipulation of the outlet closure by a mechanism which contacts the outlet closure directly, forcing it downward to shut off the water flow. Some of the mechanism are relatively complicated, involving the use of numerous parts, which tends to make the mechanism fairly expensive. Another characteristic of the inventions is that they appear to be designed to be installed through the front wall of the tank. The trend in toilet design appears to be to locate the flush handle on one of the narrow end walls of the tank.

Further, there appear to be three ways to initiate the full flush and the partial flush. With some devices, the operating handle is always turned in the same direction, and the length of time the handle is held down determines the length of the flush. A second arrangement is to have a two-part handle, where the entire handle is used for a full flush, and a part of the handle for a partial flush, or vice versa. A third arrangement involves turning the handle in one direction for a full flush, and in the opposite direction for a partial flush. This invention utilizes the third type of arrangement.

U.S. Pat. No. 4,032,997 to Phripp et al. discloses several embodiments, some of which employ a partially buoyant float. One embodiment employs a tilted water chamber. All, however, utilize direct contact to close the outlet valve.

U.S. Pat. No. 4,117,556 to Semler discloses a latch-releasable float operated by a two-way handle.

U.S. Pat. No. 4,216,555 to Detjen discloses a weighted float wherein a latch operated by the handle can release the weight or hold it in place.

U.S. Pat. No. 4,328,596 to Renz discloses a magnetic float release operated by the handle.

U.S. Pat. No. 4,391,003 to Talerico et al. discloses an upper float having a downwardly extending body which is released or retained by a two-way handle mechanism.

U.S. Pat. No. 4,624,018 to Kurtz discloses a two-element handle, one of which elements controls a float release latch.

U.S. Pat. No. 4,651,309 to Battle discloses a float, the movement of which appears to be controlled by the position of the operating handle, and the time the handle is held in a given position. (The Abstract is a little hard to fathom, being an incomplete sentence 285 words long.)

German Patent No. DE3140-033 to Kuhm discloses a device wherein a magnet may be released on to a float for premature closure of the outlet.

As mentioned above, all of the foregoing devices operate by urging a mechanical part downward onto a buoyant outlet closure.

SUMMARY OF THE INVENTION

Toilet water tanks are provided with a circular outlet opening at the bottom of the tank. Water flow through the opening is controlled by an outlet closure which can be either a ballcock or a flapper. The underside of a ballcock has a shape which cooperates with the circular outlet opening to close off the gravity flow of water from the tank. The shape of the underside of a ballcock is sometimes a truncated hemisphere, and sometimes a truncated cone but, in either case, the truncation line is lowermost and defines the opening into the buoyancy chamber. The underside of a flapper has a truncated hemispherical shape, which fits within the outlet opening of the tank, and the flapper has a generally disc-shaped flange extending radially which seats on the outlet opening of the tank to close off the gravity flow of water from the tank. Both the ballcock and the flapper are hollow and are open at the bottom. The purpose of the ballcock or flapper being hollow is to allow it to float on the vortex of exiting water when the tank is emptying, but to allow it to fall of its own weight, and close off the tank outlet when there is no longer enough water in the tank to support it.

In this invention, the partial flush is achieved by venting the hollow space inside the ballcock or flapper at a pre-selected time in the flush cycle, thereby making it non-buoyant, and causing it to fall through the water of its own weight and to close the outlet almost instantaneously, without the necessity to force the ballcock or flapper downward by direct mechanical contact.

Henceforth in this specification, only a flapper will be referred to, for the sake of simplicity, but it is understood that the principle of the invention, and the embodiment thereof, can be applied to a ballcock as easily as to a flapper. A ballcock has a metal stem extending upward, which is guided by a passageway in a bracket clamped to the overflow tube above the tank outlet opening. The lifting chain is attached to the upper end of the stem. Venting the ballcock will produce exactly the same result as venting the flapper described in the preferred embodiment of this invention.

It is an object of this invention to save water by providing a low-cost, reliable device for installation in a conventional toilet tank which permits selection of either a full flush or partial flush of the toilet.

It is a further object of this invention to provide a selectable flushing control device which can be easily adjusted for precise control of the amount of water used during a toilet flushing cycle.

It is a further object of this invention to provide a selectable flushing control device which can be installed in all standard toilet tanks.

It is a further object of this invention to provide a selectable toilet flushing device which will not corrode and which is made of wear-resistant materials.

DETAILED DESCRIPTION OF THE INVENTION

A list of materials of which the preferred embodiment of this invention is manufactured appears at the end of this specification.

Figure 1:
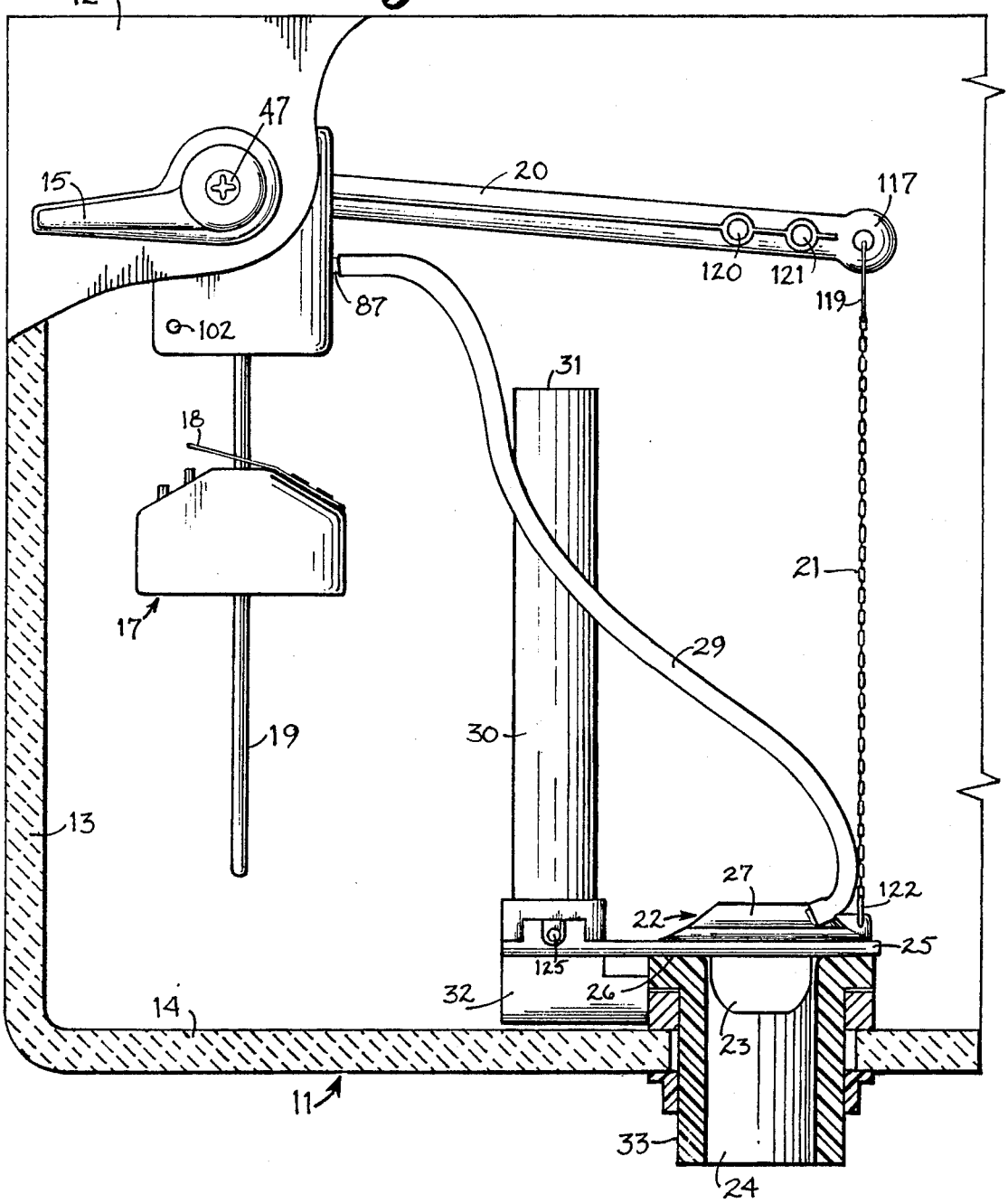
FIG. 1 is a segmented elevational view of a water closet water tank with the front wall, side wall and bottom partially cut away.
Figure 2:
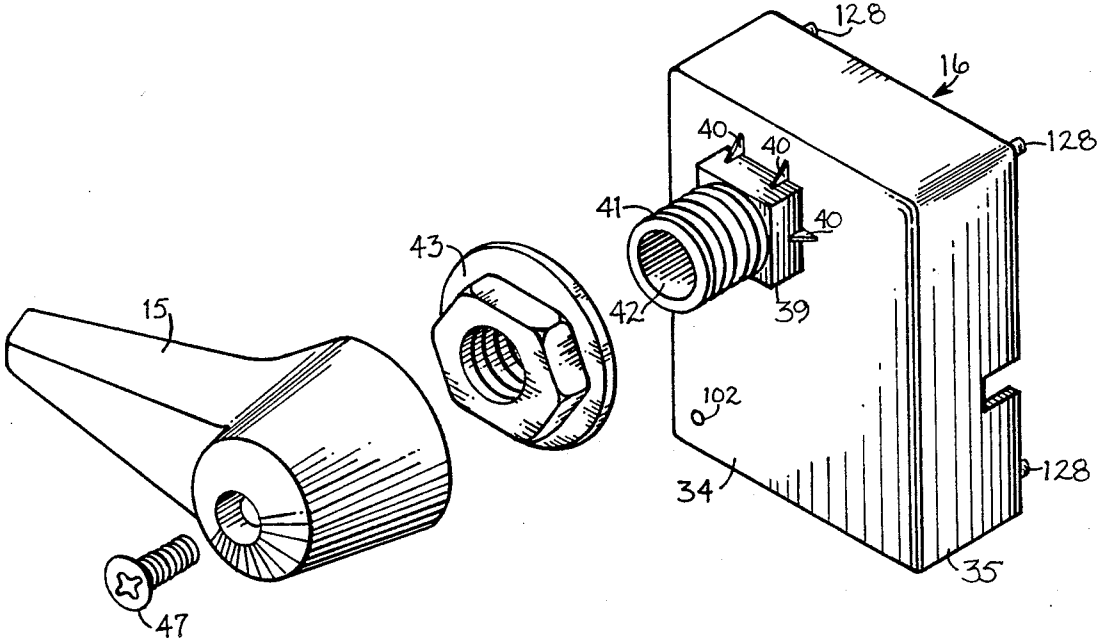
FIG. 2 is a perspective view of the housing and flange nut of this invention and of the operating handle and retaining screw.
Figure 3:
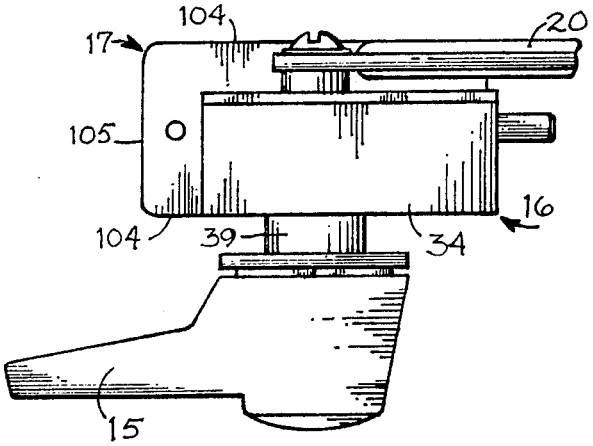
FIG. 3 is a plan view of the operating handle and the housing for the flush selection mechanism and the float as assembled, but not showing the tank front wall.
Figure 14:
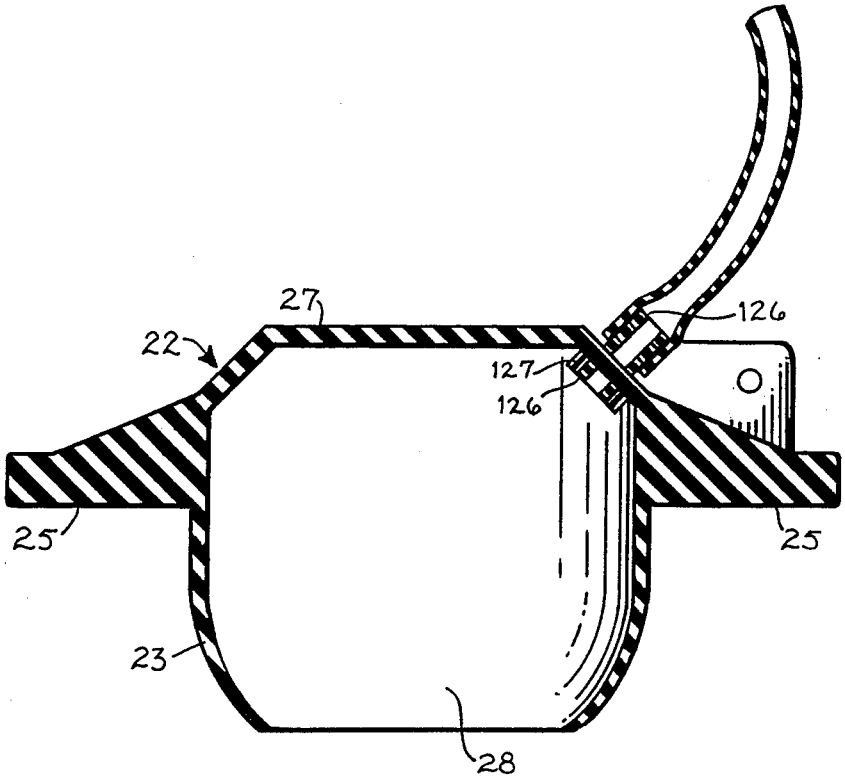
FIG. 14 is a cross-section of the flapper of this invention with the air bleed nipple and air bleed tube in place.
Figure 15:
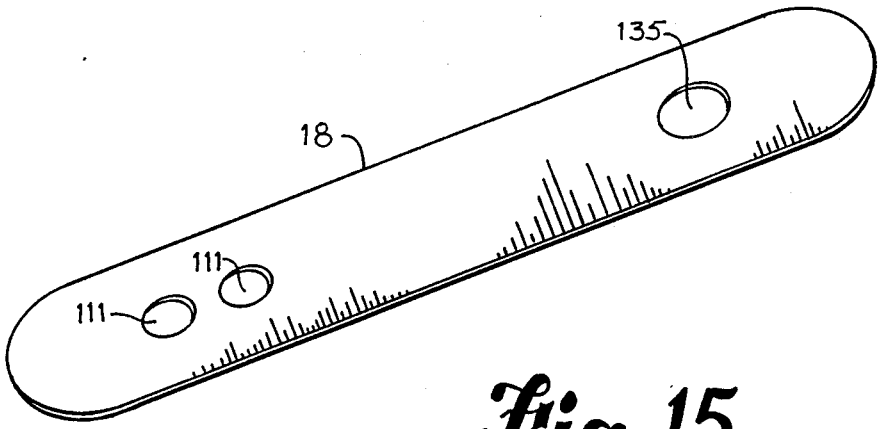
FIG. 15 is a perspective view of the float leaf spring.

The general arrangement of the invention is illustrated in FIG. 1. A conventional toilet water tank 11 is shown in part, and front wall 12, side wall 13 and bottom 14 have been partially cut away for illustrative purposes. For clarity, FIG. 1 does not show the conventional water supply pipe, water supply control valve, and the conventional fill float and arm which control the supply of water to tank. Operating handle 15 is fixed to a shaft to be described later which extends through front wall 12 of tank from housing 16. Float 17 has leaf spring 18 (see FIG. 15) which slideably secures float 17 to float stem 19 extending downward from housing 16. A flapper control arm 20, operable by operating handle 15 by means which will be described below, is connected by means of chain 21 to flapper 22. Flapper 22 (see FIG. 14) has a truncated hemispherical lower body 23 which extends downward into outlet opening 24. Flapper flange 25 rests on seat 26 of outlet opening 24, preventing water from flowing from tank 11. Flapper 22 is hollow, upper body 27 and lower body 23 together enclosing a buoyancy chamber 28 which is open at the bottom, as illustrated in FIG. 14. Air bleed tube 29 connects flapper 22 with nipple 87 extending from housing 16. The connection of the air bleed tube 29 to the flapper 22 is in the vicinity of the lifting chain 21 because, when the flapper 22 is lifted by the chain 21, that part of the buoyancy chamber 28 nearest the chain 21 becomes the highest part, and is most suitable for quick venting of the buoyancy chamber 28. The overflow pipe is of the conventional type, comprising a vertical tube 30 open at its top 31, the lower end of tube 30 being fitted into elbow 32 which conducts excess water to the outlet pipe 33 below seat 26. The water level in tank 11 is not illustrated, but before flushing is at or just below the top 31 of overflow tube 30.

The operating mechanism of this invention will now be described with reference initially to FIGS. 2, 3, 4 and 5. A hollow rectangular housing 16 has front wall 34, side wall 35 and bottom wall 36. Housing 16 has rectangular opening 37 in side wall 35, and rectangular opening 38 in bottom wall 36. Square boss 39 extends outwardly from front wall 34 of housing 16. Position wedges 40 (only 3 of 6 being shown in FIG. 2) are affixed to square boss 39 and front wall 34. Threaded boss 41 extends outwardly from square boss 39. Cylindrical passageway 42 extends through bosses 39 and 41 and front wall 34. Housing 16 is mounted to the interior of front wall 12 of toilet tank 11 by inserting square boss 39 through a square opening (not shown) in wall 12, and threading flange 43 nut onto threaded boss 41 until flange nut 43 is tight against the exterior of front wall 12. Position wedges 40 prevent rotation of housing 16 with respect to front wall 12 of tank 11. Housing 16 has pins 128 extending from each corner thereof for the purpose of assembling housing back wall 57 to housing 16.

Figure 6:
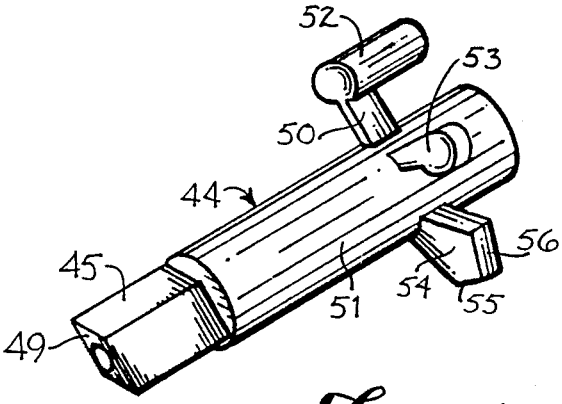
FIG. 6 is a perspective view of the upper shaft of the flush selection mechanism.

Upper shaft 44, (see FIGS. 6 and 13) which is cylindrical, has square boss 45 extending from one end 46. Upper shaft 44 is rotatably engaged in passageway 42 with square boss 45 extending externally from the tank front wall 12. Square boss 45 is suitable for cooperative attachment of operating handle 15 which is, of course, on the outside of tank 11, housing 16 being inside tank 11, as illustrated in. Operating handle 15 is retained on square boss 45 by means of screw 47 which is threaded into hole 48 extending inwardly from end surface 49 of upper shaft 44. Arm 50 extends radially from the cylindrical surface 51 of upper shaft 44. Actuating pin 52 is attached to arm 50 and is oriented parallel to the axis of upper shaft 44. Lobe 53 extends radially from cylindrical surface 51 of upper shaft 44 in approximately the same transverse plane as arm 50. Tooth 54 extends radially from cylindrical surface 51 of upper shaft 44 in approximately the same transverse plane as lobe 53 and arm 50. Tooth 54 has contact surface 55 and contact surface 56. Actuating pin 52 extends axially beyond the plane of rotation of arm 50, lobe 53 and tooth 54.

Figure 13:
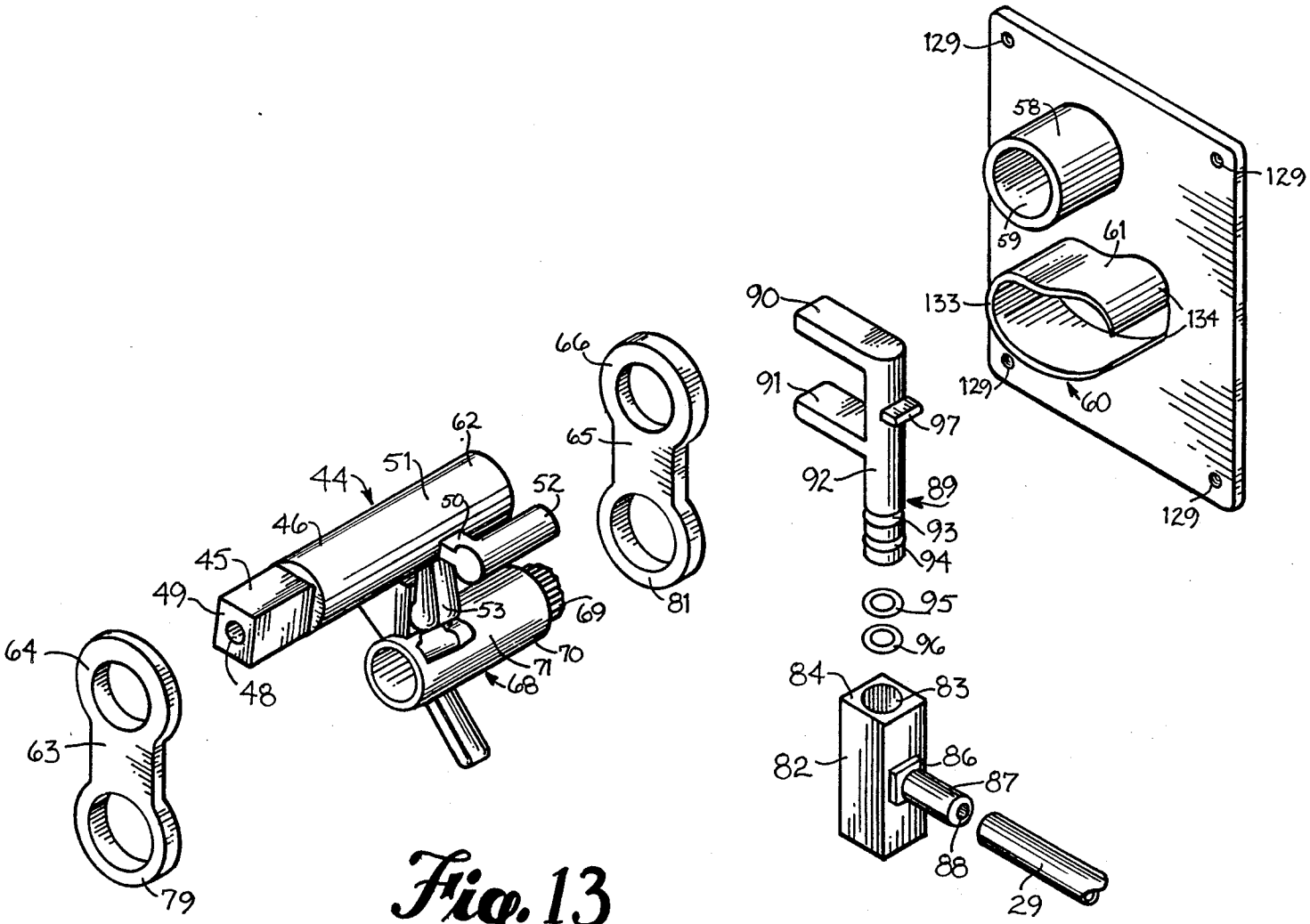
FIG. 13 is an exploded perspective view of the operating mechanism showing all the elements contained within the housing, and showing the back wall of the housing.

Housing 16 is closed by back wall 57 (see FIG. 13). Circular boss 58 with cylindrical passageway 59 therein extends into housing 16 from back wall 57. Arcuate boss 60 having wall 61 extends inwardly from back wall 57 below circular boss 58. Upper shaft 44 is supported rotatably at end 46 within cylindrical passageway 42. End 62 of upper shaft 44 is supported rotatably within cylindrical passageway 59 in circular boss 58. Back wall 57 has a hole 129 near each corner. Holes 129 cooperate with pins 128 extending from housing 16 to assemble back wall 57 to housing 16. Back wall 57 is held in place by sonic welding of pins 128 to back wall 57.

Swing arm 63 (see FIG. 13) is rotatably suspended by ring 64 from upper shaft 44 at a position between front wall 34 of housing 16 and arm 50, lobe 53 and tooth 54. Swing arm 65 is rotatably suspended by ring 66 from upper shaft 44 at a position between inner end 67 of circular boss 58 and arm 50, lobe 53 and tooth 54.

Figure 7:
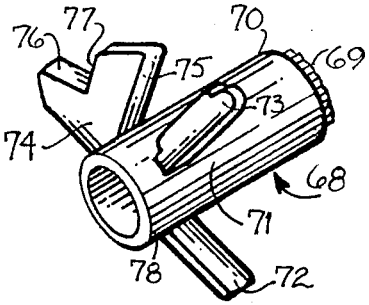
FIG. 7 is a perspective view of the lower shaft of the flush selection mechanism.

Lower shaft 68 (see FIGS. 7 and 13) is cylindrical and has male spline member 69 extending from end 70. Extending radially from cylindrical surface 71 of lower shaft 68 are stop 72, pin 73 and tooth 74 which has contact surfaces 75, 76 and 77. End 78 of lower shaft 68 is suspended in eye 79 of swing arm 63 and end 80 of lower shaft 68 is suspended in eye 81 of swing arm 65. End 70 of lower shaft 68 extends through arcuate boss 60 so that male spline member 69 is outside housing 16. The purpose of pin 73 on lower shaft 68 is to insure that upper shaft 44 and lower dhaft 68 will stay in proper rotational relationship to each other. If someone takes the top off the toilet tank and maniulates the operating arm 20, it might be possible to rotate lower shaft 68 until tooth 74 was out of synchronization with tooth 54. Pin 73 will prevent that from occurring, because pin 73 will act on lobe 53 so as to turn upper shaft 44 and, therefore, actuating pin 52 to a position where pin 73 will cause actuating pin 52 to rotate upper shaft 44 when operating arm 20 is moved in the opposite direction; thus, upper shaft 44 and lower shaft 68 will always mesh properly.

Valve body 82 (see FIG. 13) has cylindrical valve chamber 83 extending downward from upper surface 84. Near the bottom of valve body 82, chamber 83 narrows to a small diameter passageway 85. Rectangular boss 86 extends perpendicularly from the side of valve body 82. Boss 86 extends through hole 37 in side wall 35, its shape cooperating with the shape of hole 37 so as to keep valve body 82 in proper orientation. Cylindrical nipple 87 extends outwardly from boss 86. Air bleed passageway 88 extends through nipple 87 and boss 86 and intersects valve chamber 83.

Valve 89 (see FIG. 13) is generally F-shaped. Spaced-apart upper arm 90 and lower arm 91 extend perpendicularly from stem 92. Near the lower end of stem 92, upper groove 93 and lower groove 94 are provided for the retention of upper O-ring 95 and lower O-ring 96 respectively. Orientation pin 97 is attached tangentially to stem 92 in the area of arms 90 and 91, but on the opposite side of stem 92 from said arms. The purpose of orientation pin 97 is to prevent substantial rotation of stem 92, and therefore of arms 90 and 91 within housing 16.

Figure 4:
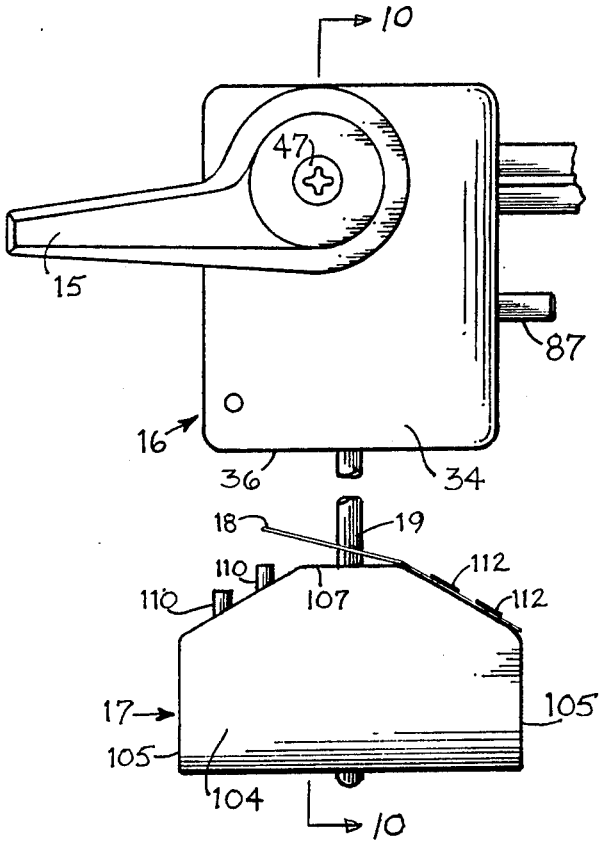
FIG. 4 is a front elevational view of the elements of FIG. 3.
Figure 5:
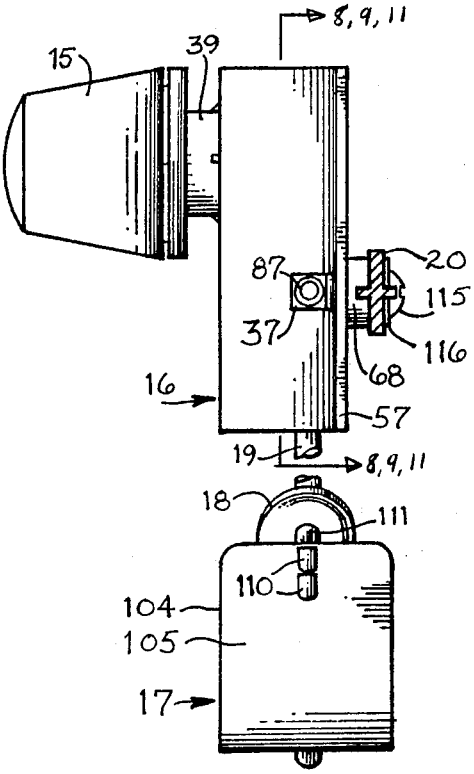
FIG. 5 is a side elevational view of the elements of FIG. 3.
Figure 17:
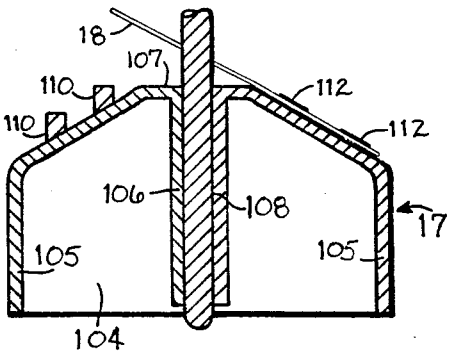
FIG. 17 is a cross-sectional view of the float assembly.

Float stem 19 (see FIGS. 1, 4, 5, 10 and 11) is cylindrical and is generally T-shaped. The upper end of float stem 19 comprises crossarm 98 having hinge pin 99 at one end and stopper pin 100 extending upwardly at the other end. Hinge pin 99 has a cylindrical boss 101 extending from each end thereof. Cylindrical bosses 101 cooperate with holes 102 in front wall 34 and back wall 57 of housing 16. The hole 102 in back wall 57 is not illustrated, but is located directly opposite hole 102 in front wall 34. Stopper 103 is press-fitted to stopper pin 100 by means of a slit (not shown) in the bottom of stopper 103, and extends upwardly from stopper pin 100. Float 17 (see FIG. 17) having an open bottom, the periphery of which is defined by the lower edge of sidewalls 104 and end walls 105, has cylindrical member 106 extending downwardly from the center of top wall 107. Passageway 108 in cylindrical member 106 is larger than the diameter of float stem 19. Leaf spring 18 (see FIG. 15) is fixedly attached to one of the transition walls 109 of float 17. FIGS. 1, 4, 5 and 11 show two projections 110 extending from one of the transition walls 109 of float 17. These projections 110 are formed during manufacture of float 17, and cooperate with holes 111 in leaf spring 18. To assemble leaf spring 18 tightly to float 17, leaf spring 18 is placed on float 17 with projections 110 extending through holes 111 in leaf spring 18, and the projections 110 are then softened and spread over the spring by sonic welding or similar means, the result being retainers 112, as illustrated in FIG. 4, for example. Crossarm 98 lies within housing 16 with stopper 103 normally in contact with, and closing off, small passageway 85 in valve chamber 83 when float 17 is wholly or partially submerged and, therefore, being urged upward by the water in tank 11.

Figure 12:
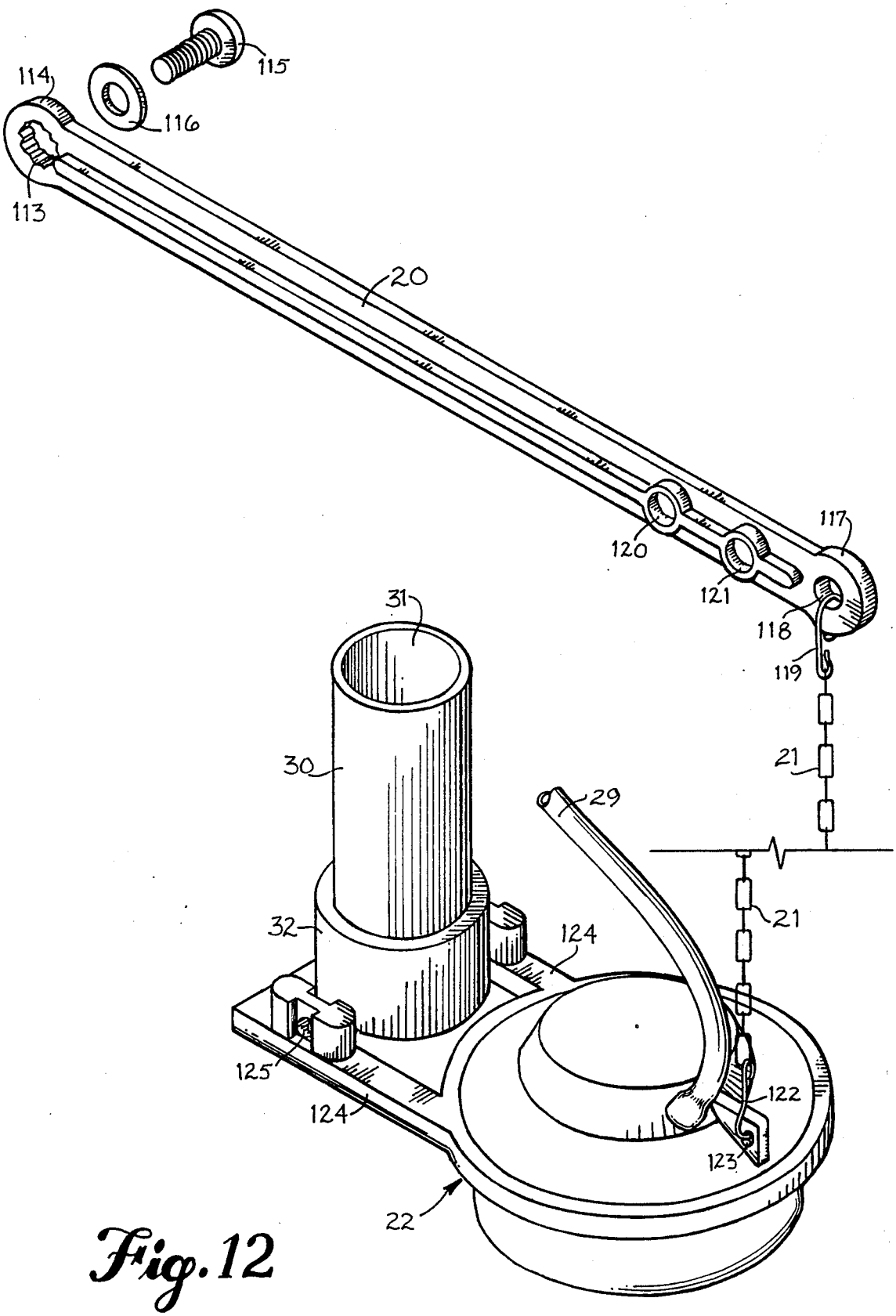
FIG. 12 is a perspective view of the operating arm, chain and tlapper.

Flapper control arm 20 (see FIG. 12) has female spline 113 in end 114, which is fitted to male spline 69 on lower shaft 68, and affixed thereto by screw 115 and washer 116. End 117 of flapper control arm 20 has eye 118 for the purpose of retaining upper hook 119 of chain 21. Additional eyes 120 and 121 are provided so that the invention can be fitted to toilet water tanks having the outlet opening 24 in different places. Lower hook 122 of chain 21 is inserted through hole 123 in flapper 22 in the conventional manner. Flapper 22 (see FIG. 14) has legs 124 extending outwardly which cooperate rotatably with pins 125 extending from elbow 32 of overflow pipe 30. Flapper 22 is hollow and extends both above and below flange 25. Upper body 27 can have any shape but, in this embodiment, has the shape of a truncated cone with the smaller end upward. Lower body 23 has, in cross-section, the shape of a truncated hemisphere with the smaller diameter downward. There is no bottom surface to lower body 23, so that upper body 27 and lower body 23 together form a hollow chamber with no bottom. Flapper 22 is conventional in all respects but one. The one difference is that a nipple 126 having flange 127 within buoyancy chamber 28 extends outwardly therefrom, providing a bleed air passageway from the buoyancy chamber 28.

A flexible air bleed tube 29 connects nipple 126 in flapper 22 with nipple 87 of valve body 82, thus forming a continuous air passageway from flapper buoyancy chamber 28, through tube 29 and bleed passageway 88 to valve chamber 83.

Figure 11:
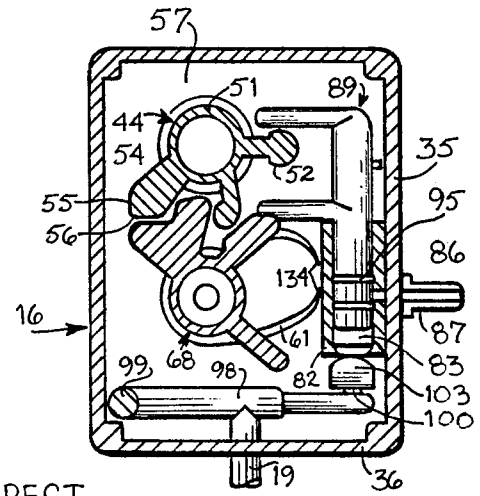
FIG. 11 is a sectional view taken at line 8, 9, 11—8, 9, 11 of FIG. 5 showing the mechanism when it is not in a flush cycle.
Figure 11:
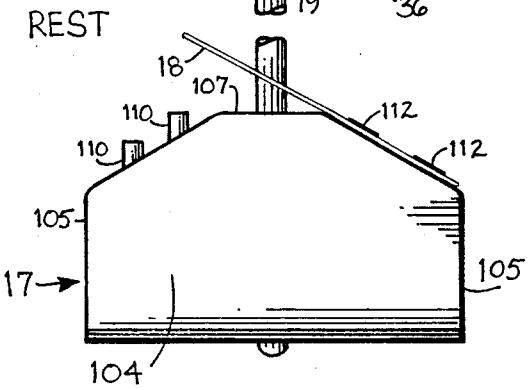
Figure 10:
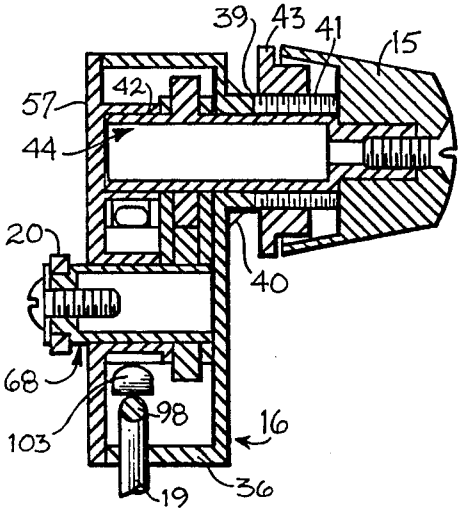
FIG. 10 is a sectional view taken at line 10—10 of FIG. 4.
Figure 10:
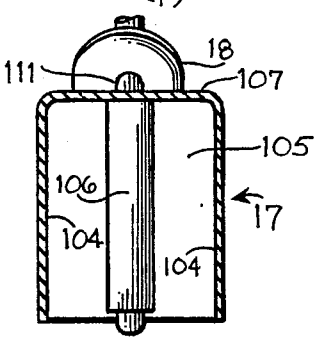

The operation of the mechanism will now be described. The position of the mechanism "at rest" is illustrated in FIG. 11 which is a cross-section through the plane of operation of the parts which extend radially outward from upper shaft 44 and lower shaft 68. It will be noted that in the "at rest" position, upper O-ring 95 lies above bleed passageway 88 in valve body 82, and lower O-ring 96 lies below bleed pasageway 88. Buoyancy chamber 28 in flapper 22 is thus sealed off, and air cannot escape therefrom when O-rings 95 and 96 are in the position just described.

Figure 9:
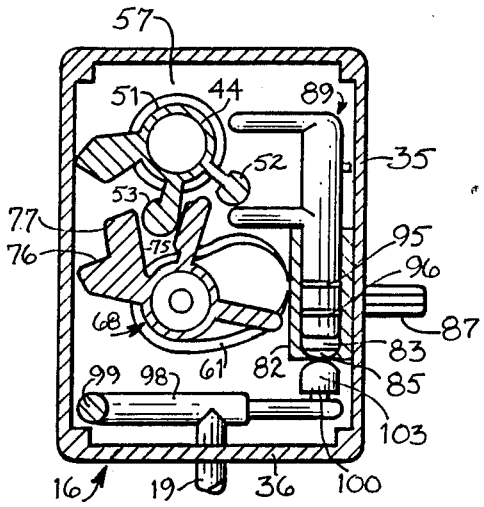
FIG. 9 is a sectional view taken on line 8, 9, 11—8, 9, 11 of FIG. 5 showing the mechanism as it appears when a full flush is initiated.

Referring now to FIG. 9, when a full flush cycle is desired, operating handle 15 is rotated upward so as to turn upper shaft 44 in a clockwise direction, and lobe 53 will engage surface 77 of tooth 74 on lower shaft 68 so as to turn lower shaft 68 counterclockwise. The force exerted by lobe 53 will also tend to urge lower shaft 68 to swing counterclockwise because lower shaft 68 is completely suspended from upper shaft 44 by swing arms 63 and 65. Lower shaft 68 is prevented from swinging around upper shaft 44, however, because end 70 of lower shaft 68 bears against lower end 133 of arcuate boss 60. The result is that lower shaft 68 merely rotates counter-clockwise, and does not move laterally. When lower shaft 68 rotates counter-clockwise, two things happen. One is that flapper operating arm 20 is rotated counter-clockwise, raising flapper 22 in the conventional manner and allowing tank 11 to empty. At the same time, actuating pin 52 has contacted lower arm 91 of valve 89, forcing valve stem 92 downward. The downward motion is not sufficient, however, to cause upper O-ring 95 to move to or below bleed passageway 88. Flapper 22, therefore, remains buoyant, not having been vented, and the toilet goes through a full flush cycle. Float 17 drops when the water level in the tank 11 has lowered sufficiently, and valve chamber 83 becomes open to the tank 11, but bleed passageway 88 remains sealed because of the position of O-rings 95 and 96. Flapper 22 thus remains buoyant and closes the tank outlet 24 only at the end of the full flush cycle.

Figure 8:
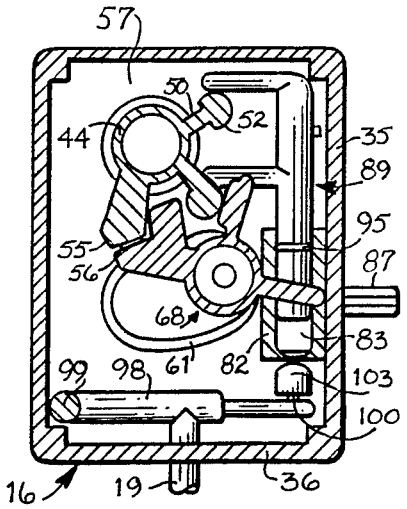
FIG. 8 is a sectional view taken on line 8, 9, 11—8, 9, 11 of FIG. 5 showing the mechanism as it appears when a partial flush is initiated.

In a partial flush cycle, the rotational positions of upper shaft 44 and lower shaft 68, and of valve 89 are shown in FIG. 8. Operating handle 15 has been depressed causing upper shaft 44 to rotate counter-clockwise. Actuator pin 52 has contacted upper arm 90 of valve 89 causing it to move upwards, lifting lower O-ring 96 above the intersection of bleed passageway 88 and valve chamber 83, thus allowing air to flow from buoyancy chamber 28 to valve chamber 83. Tooth 54 on upper shaft 44 has wedged in between contact surfaces 75 and 76 of tooth 74 on lower shaft 68, forcing lower shaft 68 to swing around the axis of upper shaft 44 until lower shaft 68 bears against the upper end 134 of arcuate boss 60. This combined swinging and elevating motion lifts flapper operating arm 20 and causes flapper 22 to lift off outlet opening 24, starting a flush cycle. As the water level drops, flapper 22 will remain buoyant until stopper 103 at the end of crossarm 98 of float stem 19 drops away from small passageway 85 at the lower end of valve chamber 83, thus forming a complete passageway for the air in buoyancy chamber 28 of flapper 22 to vent to toilet water tank 11. The timing of that release of air from flapper 22 is determined by the position of float 17 on stem 19. Float 17 is always submerged at the start of a cycle, and will remain submerged until the water level in tank 11 has dropped to a point where float 17 is no longer in contact with the water. At that point, float 17 is prevented from dropping further because crossarm 98 is resting on the bottom wall 36 of housing 16. When float 17 drops and opens the air passageway, buoyancy chamber 28 is vented, and flapper 22 immediately falls, and closes tank outlet 24. It can thus be seen that the position of float 17 on stem 19 controls the time in the flush cycle at which the flush cycle will be terminated. Leaf spring 18 has hole 135 near one end. Hole 135 is of larger diameter than float stem 19 and is so oriented that, when leaf spring 18 is depressed, hole 135 will line up with passageway 106 in float 17 and will allow float 17 to be moved up and down on float stem 19. Releasing leaf 18 spring secures float 17 to stem 19. Moving float 17 up on stem 19 shortens the partial flush cycle, whereas moving float 17 down on stem 19 lengthens the partial flush cycle.

In either flushing mode, full or partial, when operating handle 15 is released, the mechanism will return to the 'at rest' position because of the downward force exerted by the weight of flapper 22 pulling on end 117 of operating arm 20.

It should also be noted, with reference to nipple 126 which extends through upper body 27 of flapper 22, that nipple 126 should be located as close as reasonably possible to the lifting eye 123 of flapper 22. That location will provide the quickest and most complete venting of buoyancy chamber 28 because air will then be bled from buoyancy chamber 28 at or near its top when flapper 22 is lifted by chain 21.

Figure 16:
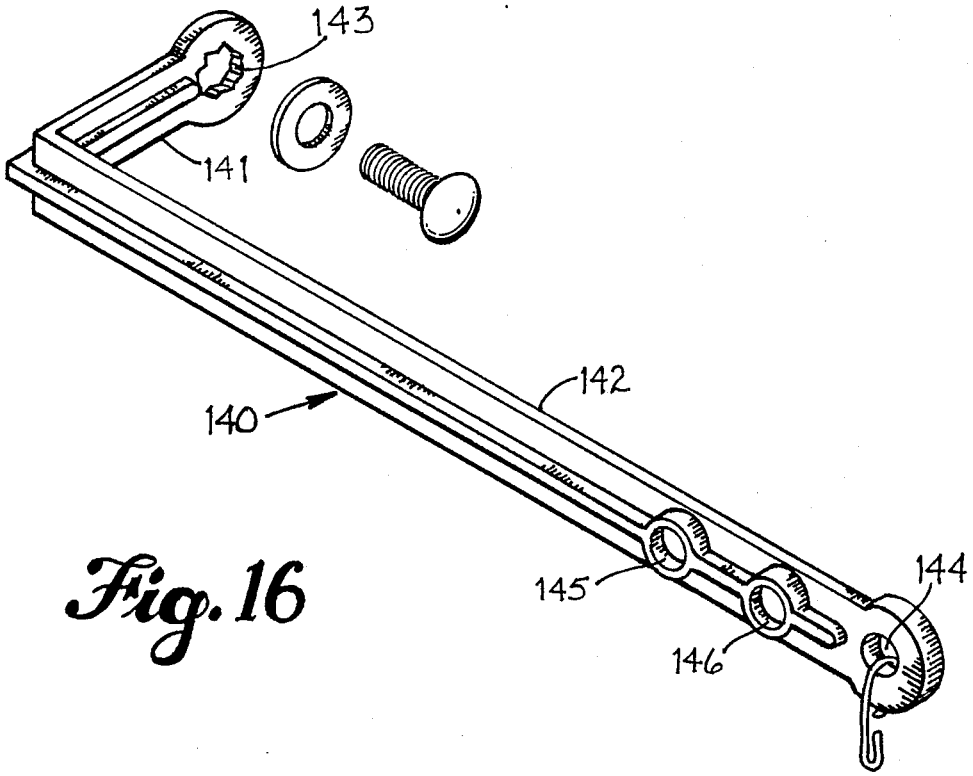
FIG. 16 is a perspective view of a flapper operating arm for adapting this invention to toilet tanks having the operating handle extending from the end of the tank.

A second embodiment of this invention permits the invention to be installed through the end wall of a toilet water tank, as required in some modern water closet designs, rather than through the front wall. It is necessary only to substitute the L-shaped flapper control arm 140 of FIG. 16 for the flapper control arm 20 of the previously described embodiment. Flapper control arm 140 has a short attachment arm 141 which is at right angles to the lifting arm 142. There is a female spline 143 in attachment arm 141, and an eye 144 at the free end of lifting arm 142 for insertion of upper hook 119 of chain 21. Additional eyes 145 and 146 are provided to allow for different models of water tank 11. Flapper control arm 140 is installed with attachment arm 141 extending horizontally in the opposite direction from operating handle 15.

While it should be recognized that this invention could be manufactured of any of a wide variety of materials and still operate satisfactorily, the preferred embodiment described herein is manufactured of the following materials:

Screws 47 and 115 and washer 116: Chrome-plated steel.

Float 17: Polyethylene.

Leaf spring 18 and chain 21: Stainless steel.

Flapper 22, stopper 103 and O-rings 95 and 96: Neoprene.

Air bleed tube 29: Latex.

Valve 89: Acetal 279 nylon.

Flange nut 43, housing 16, swing arms 63 and 65, upper shaft 44, lower shaft 68, flapper control arm 20, float stem 19, nipple 126 and housing back wall 57: Acetal 270 nylon.

While this invention is susceptible of embodiment in different forms, the drawings and the specification illustrate the preferred embodiment of the invention, with the understanding that the present disclosure is to be considered an exemplification of the principles of the invention, and the disclosure is not intended to limit the invention to the particular embodiment described.

We claim:

1. In a water closet comprising a toilet bowl and a water supply tank located at a level higher than the toilet bowl, the tank having vertical walls, a bottom and an openable top, and having conventional water filling means, an outlet opening through the tank bottom, and an outlet closure with an integral buoyancy chamber, an apparatus for accomplishing selectively either a discharge to the toilet bowl of substantially all the water in the tank, or a reduced discharge of a pre-selected volume of water, the reduced discharge being accomplished by venting the outlet closure buoyancy chamber at a selectively pre-determined time in the flush cycle, thereby causing the outlet closure to fall and to close the outlet opening before substantially all of the water has been discharged from the tank, wherein the apparatus for accomplishing selectively either a full flush, or a partial flush using a preselected volume of water comprises:

an air bleed passageway from the outlet closure buoyancy chamber to the toilet water tank, the passageway being closed in two locations relative to the water tank when the water closet is not in a flushing cycle;

a first means selectable at the beginning of a flush cycle to select whether the air bleed passageway will remain open at the first location for a full flush or will be opened for a partial flush;

a second means to open the air bleed passageway at the second location at a pre-determined time during any flushing cycle;

an externally mounted operating handle mounted on said tank and including means connected to said outlet closure, said handle being; rotatable in one direction for actuating said closure to produce a full discharge of water into the toilet bowl, and rotatable in the opposite direction for actuating said closure to produce a partial discharge of water into the tank; and said means being operable by the operating handle to lift the outlet closure above the outlet opening when the operating handle is moved in either direction.

2. The apparatus of claim 1 wherein the air bleed passageway comprises:

a nipple fitted through a wall of the buoyancy chamber;

a valve chamber having a first opening and a second opening;

a nipple connected to the first opening;

a flexible tube connecting the buoyancy chamber nipple to the valve chamber nipple; and the second opening of the valve chamber communicating directly with the water tank when not closed by the second means of claim 1.

3. The apparatus of claim 2 wherein the first means comprises:

a valve stem protruding from an end of the valve chamber;

spaced-apart first and second O-rings retained in grooves on the valve stem, and providing an essentially air-tight sliding fit with respect to the valve chamber;

the first O-ring being located, at all times in all flushing cycles, between the first opening in the valve chamber and the end of the valve chamber from which the valve stem protrudes;

the second O-ring being so located as to be between the first opening and the second opening of the valve chamber at one limit of the full linear travel of the valve stem as well as when the apparatus is not being used, thus closing off the bleed air passageway, and so as to be between the first opening and the end of the valve chamber from which the valve stem protrudes at the other limit of the full linear travel of the valve stem, thus allowing air to move from the first opening of the valve chamber to the second opening thereof; and a means to position the valve stem selectively at the start of a flush cycle so as to prevent the flow of air between the first and second openings of the valve chamber, or to allow the flow of air between said openings.

4. The apparatus of claim 3 wherein the second means comprises a float-actuated stopper cooperating with the second opening of the valve chamber to close the second opening when the water in the tank is above a predetermined level, and to open the second opening when the water has dropped below that level.

5. The apparatus of claim 4 wherein the means to position the valve stem selectively comprises:

a hollow housing having the shape of a rectangular parallelepiped, said housing having a front wall affixed to an inner surface of a wall of the water tank, a back wall opposite the front wall, and a bottom;

the valve chamber being affixed to an interior surface of a side wall of the housing, wherein the chamber has a centerline that is approximately vertical;

two spaced-apart arms extending perpendicuarly from that portion of the valve stem which protrudes from the valve chamber;

a first shaft having a center rotatably contained within the housing and extending outward therefrom through the housing front wall and the water tank wall and affixed to the external operating handle;

an actuating pin extending from the first shaft and oriented parallel thereto and positioned between the spaced-apart arms extending from the valve stem; and a bearing support extending inwardly from the housing back wall for supporting the first shaft.

6. The apparatus of claim 4 wherein the means operable by the operating handle to lift the outlet closure above the outlet opening when the operating handle is rotated in either direction comprises:

an arcuate slot penetrating the back wall of the hollow housing, the arcuate slot having semicircular upper and lower ends, the lower end being the lowermost portion of the arcuate slot and being located below the first shaft bearing support, and the arcuate slot being oriented along a circular arc having an arc center, wherein the arc center is located at the center of the first shaft bearing support;

a second shaft located within the housing and having a portion extending outwardly through the arcuate slot into the water tank, said second shaft resting against the lower end of the arcuate slot when the apparatus is not being operated, as well as when the apparatus is in a full flush cycle;

an outlet closure lifting arm rigidly attached at a first end to the portion of the second shaft which protrudes into the tank;

a chain linking the outlet closure with a second end of the outlet closure lifting arm;

a means to suspend the second shaft from the first shaft, the second shaft being rotatable within the suspension means;

a means on the first shaft and the second shaft to cause the second shaft to rotate about its own axis when the operating handle is moved to the full flush position, said means comprising a lobe extending from the first shaft cooperating with a first surface of a tooth extending from the second shaft in a manner causing the second shaft to rotate and to swing against the lower end of the arcuate slot;

a means on the first shaft and the second shaft to cause the second shaft to swing about the first shaft, and thereby to raise the second shaft, without rotating it on its own axis, when the operating handle is moved to the partial flush position, said means comprising a tooth extending from the first shaft, the tooth becoming removably wedged between a second and third surfaces of the tooth extending from the second shaft; and a means to limit the swing of the second shaft about the first shaft.

7. The apparatus of claim 6 wherein the means to limit the swing of the second shaft about the first shaft comprises:

the upper end of the arcuate slot; and a stop pin extending from the second shaft which contacts a housing wall at approximately the same time the second shaft moves against the upper end of the arcuate slot.

8. The apparatus of claim 5 wherein the float-actuated stopper comprises:

a float having a straight passageway extending vertically therethrough;

a float stem slideable in the straight passageway, the float stem comprising:

a crossarm positioned within the hollow housing at the bottom thereof;

a pin extending upward at a first end of the crossarm;

a compressible stopper affixed to the pin and extending upward therefrom and closing the second opening in the valve chamber when the float is urged upward by the water in the tank;

a hinge pin affixed perpendicularly and horizontally at a second end of the crossarm;

a round boss located at each end of the hinge pin cooperating with holes in the hollow housing so as to allow the crossarm to rotate around the hinge pin;

a slender stem extending downward from a center portion of the crossarm through an opening in the bottom of the housing and through the straight passageway in the float; and a means for holding the float at any desired position along the stem below the housing.

9. The float-actuated stopper of claim 8 wherein the means for holding the float at any desired position along the stem comprises a leaf spring affixed at a first end to an angular section of a top portion of the float, the leaf spring having a hole near a second end, the hole being slightly larger than the stem, and the spring being affixed so as to extend angularly across the centerline of the straight passageway in the float in a position where, when the spring is manually depressed, the hole in the spring will line up with the float passageway, allowing free movement of the float up and down the stem and where, when the spring is not depressed, one edge of the spring hole will contact the stem, preventing movement of the float along the stem.

* * * * *